US008858172B2

(12) United States Patent
Kurihara et al.

(10) Patent No.: US 8,858,172 B2
(45) Date of Patent: Oct. 14, 2014

(54) METHOD OF MANUFACTURING ROTOR ASSEMBLY, ROTOR ASSEMBLY, AND TURBO COMPRESSOR

(75) Inventors: Kazuaki Kurihara, Yokohama (JP); Kentarou Oda, Yokohama (JP); Noriyasu Sugitani, Yokohama (JP); Minoru Tsukamoto, Yokohama (JP); Nobusada Takahara, Kamiina-gun (JP)

(73) Assignee: IHI Corporation (JP)

( * ) Notice: Subject to any disclaimer, the term of this patent is extended or adjusted under 35 U.S.C. 154(b) by 853 days.

(21) Appl. No.: 13/072,917

(22) Filed: Mar. 28, 2011

(65) Prior Publication Data

US 2011/0236204 A1 Sep. 29, 2011

(30) Foreign Application Priority Data

Mar. 29, 2010 (JP) ..... P2010-074929

(51) Int. Cl.

| | |
|---|---|
| ***F04D 29/04*** | (2006.01) |
| ***F04D 29/053*** | (2006.01) |
| ***F04D 25/04*** | (2006.01) |
| ***F04D 29/62*** | (2006.01) |

(52) U.S. Cl.

CPC ..... *F04D 29/053* (2013.01); *F04D 25/04* (2013.01); *F04D 29/624* (2013.01)

USPC ..... 415/229; 415/60; 416/198 A

(58) Field of Classification Search

USPC ..... 415/60, 62, 66, 68, 229; 416/198 R, 416/198 A, 204 A; 417/407

See application file for complete search history.

(56) References Cited

U.S. PATENT DOCUMENTS

| | | | | |
|---|---|---|---|---|
| 2009/0193840 | A1 | 8/2009 | Kurihara et al. | 62/648 |
| 2009/0193842 | A1 | 8/2009 | Tsukamoto et al. | 62/498 |
| 2009/0193845 | A1 | 8/2009 | Sugitani | 62/510 |
| 2009/0246058 | A1 * | 10/2009 | Komai et al. | 418/55.3 |

FOREIGN PATENT DOCUMENTS

| | | |
|---|---|---|
| CN | 101581318 A | 11/2009 |
| JP | 8-074832 | 3/1996 |
| JP | 2007-177695 | 7/2007 |
| JP | 2009-002277 | 1/2009 |
| JP | 2009-185715 | 8/2009 |
| JP | 2009-264370 | 11/2009 |

OTHER PUBLICATIONS

Chinese Office Action, dated Feb. 6, 2013, issued in corresponding Chinese Application No. 201110075167.0 English translation included. Total 15 pages.

Office Action dated Nov. 12, 2013 issued in corresponding Japanese Patent Application No. 2010-074929 with English translation.

Chinese Office Action, dated Jul. 25, 2013, issued in corresponding Chinese Patent Application No. 201110075167.0, including English translation. Total 13 pages.

* cited by examiner

*Primary Examiner* — Edward Look
*Assistant Examiner* — Maxime Adjagbe
(74) *Attorney, Agent, or Firm* — Ostrolenk Faber LLP

(57) ABSTRACT

A method of manufacturing a rotor assembly in which a first impeller and a second impeller are fixed to a rotation shaft which is supported by a bearing so as to be rotatable, the method including: fixing the second impeller to the rotation shaft; fitting and fixing a sleeve to the rotation shaft after fixing the second impeller; fitting and fixing the bearing to the sleeve after fitting and fixing the sleeve; and fixing the first impeller after fitting and fixing the bearing.

5 Claims, 3 Drawing Sheets

METHOD OF MANUFACTURING ROTOR ASSEMBLY, ROTOR ASSEMBLY, AND TURBO COMPRESSOR

BACKGROUND OF THE INVENTION

1. Field of the Invention

The present invention relates to a method of manufacturing a rotor assembly, a rotor assembly, and a turbo compressor.

Priority is claimed on Japanese Patent Application No. 2010-074929, filed on Mar. 29, 2010, the content of which is incorporated herein by reference.

2. Description of Related Art

Typically, a turbo compressor that compresses and discharges a gas such as air or a refrigerant gas by rotating an impeller is known (for example, refer to Japanese Unexamined Patent Application, First Publication No. 2007-177695). The impeller is fixed to a rotation shaft, and the rotation shaft is supported by a bearing so as to be rotatable. The rotation shaft and the impeller are rotated by the rotating power of a predetermined driving device (a motor or the like), and as the impeller is rotated, the gas is sent to a diffuser formed at the periphery of the impeller to be compressed.

The impeller, the rotation shaft, and the bearing may be assembled into a rotor assembly before being built in the turbo compressor. In a turbo compressor having two compression stages as disclosed in Japanese Patent Application No. 2007-177695, two impellers are provided on both sides with a predetermined bearing interposed therebetween. In addition, on the opposite side of a rotation shaft to the side to which an impeller is fixed, a pinion gear is molded integrally with a rotation shaft main body. Accordingly, the rotor assembly may be assembled in the order of fitting the bearing to a supporting portion after passing one impeller through the supporting portion of the rotation shaft supported by the bearing and fixing the impeller thereto at a predetermined position.

However, when a long bearing life span needs to be ensured, for example, using a large bearing is considered. In order to use the large bearing, the rotation shaft needs to be of a thickness corresponding to the inside diameter of the bearing. However, as described above, during assembly of the rotor assembly, the one impeller is first passed through the supporting portion of the rotation shaft. Accordingly, it is difficult to use a thick rotation shaft, and thus it is difficult to ensure a long bearing life span using the large bearing.

In order to solve the problems, an object of the invention is to provide a method of manufacturing a rotor assembly, a rotor assembly, and a turbo compressor having the same, capable of ensuring a long bearing life span with the use of a large bearing.

In order to accomplish the object, the invention employs the following apparatus.

SUMMARY OF THE INVENTION

According to a first aspect of the invention, there is provided a method of manufacturing a rotor assembly in which a first impeller and a second impeller are fixed to a rotation shaft which is supported by a bearing so as to be rotatable, the method including: fixing the second impeller to the rotation shaft; fitting and fixing a sleeve to the rotation shaft after fixing the second impeller; fitting and fixing the bearing to the sleeve after fitting and fixing the sleeve; and fixing the first impeller after fitting and fixing the bearing.

In the method of manufacturing a rotor assembly according to the first aspect of the invention, after fixing the second impeller to the rotation shaft, the sleeve is fitted and fixed to the rotation shaft, and the bearing is fitted and fixed to the sleeve. That is, instead of thickening the rotation shaft, the sleeve is used, so that it becomes possible to use a large bearing.

In addition, the method of manufacturing a rotor assembly according to a second aspect of the invention includes, before fitting and fixing the sleeve, adjusting the sleeve to an outside diameter measurement corresponding to a change in an outside diameter of the sleeve which is going to be caused while fitting and fixing the sleeve.

In the method of manufacturing a rotor assembly according to the second aspect of the invention, in the sleeve adjusting step, the sleeve is adjusted to the outside diameter measurement corresponding to the change in the outside diameter caused in the sleeve fixing step. Accordingly, there is no need to perform machining work on the outer peripheral surface of the sleeve in order to ensure a suitable interference between the sleeve and the bearing after the sleeve fixing step.

In addition, in the method of manufacturing a rotor assembly according to a third aspect of the invention, in adjusting the sleeve, the sleeve is adjusted to the outside diameter measurement obtained by subtracting the expansion amount of the outside diameter of the sleeve which is going to be caused while fitting and fixing the sleeve, from a predetermined outside diameter measurement.

According to a fourth aspect of the invention, there is provided a rotor assembly including: a rotation shaft supported by a bearing so as to be rotatable; two impellers fixed to the rotation shaft; and a sleeve which is fitted and fixed to the rotation shaft and is provided inside the bearing.

In the rotor assembly according to the fourth aspect of the invention, since the bearing is provided on the rotation shaft with the sleeve interposed therebetween, it becomes possible to use a large bearing without thickening the rotation shaft.

According to a fifth aspect of the invention, there is provided a turbo compressor which compresses a gas introduced from the outside so as to be discharged by rotating a rotor assembly including two impellers, and as the rotor assembly, the rotor assembly according to the fourth aspect is included.

According to the invention, the sleeve is provided on the rotation shaft, so that a large bearing can be used. Therefore, a long bearing life span can be ensured.

DETAILED DESCRIPTION OF THE INVENTION

Figure 1:
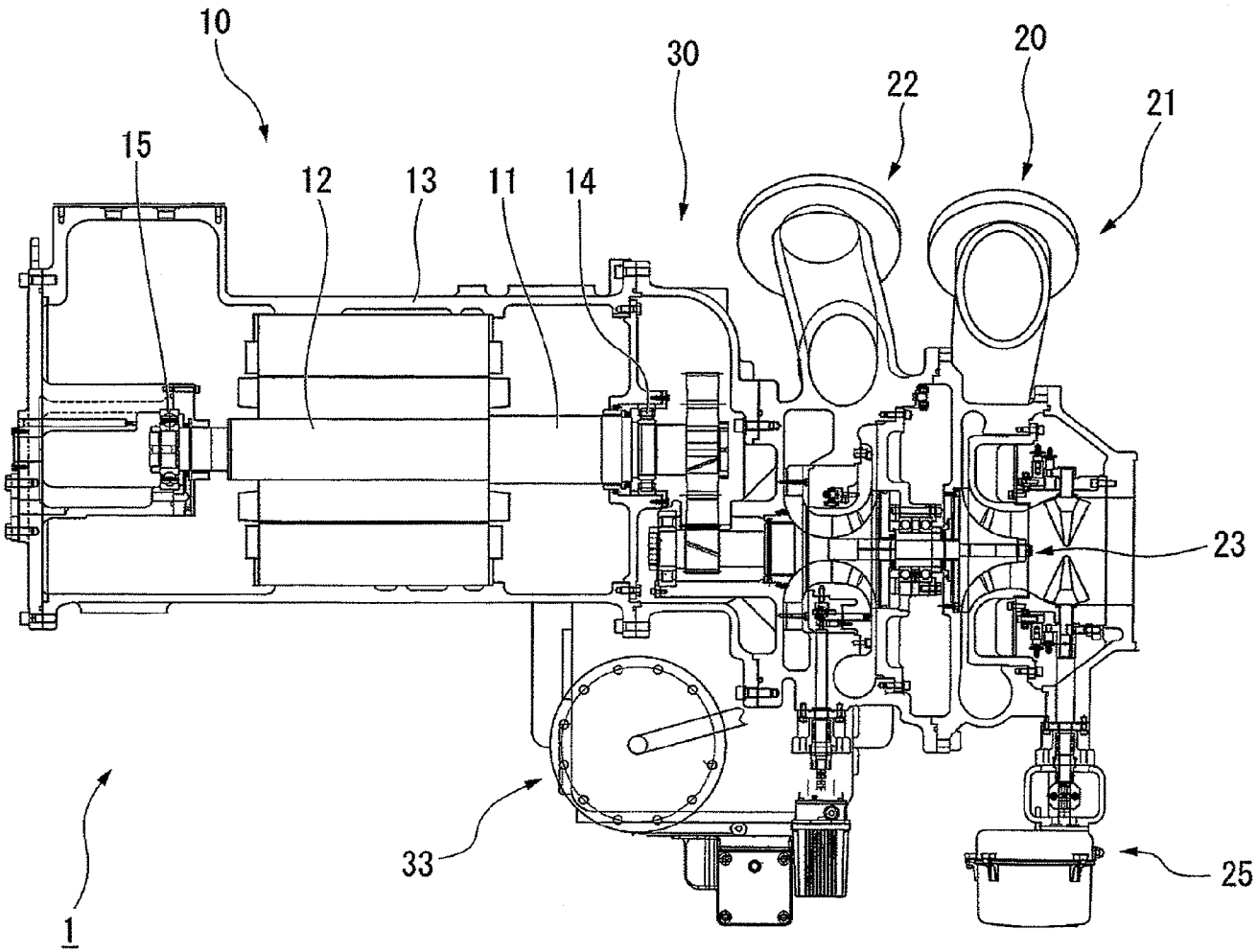
FIG. 1 is a horizontal cross-sectional view of a turbo compressor according to an embodiment of the invention.

Hereinafter, exemplary embodiments of the invention will be described with reference to FIGS. 1 to 4. In addition, in the drawings used for the following description, in order to allow each member to have a recognizable size, the scale of each member is appropriately changed.

Figure 2:
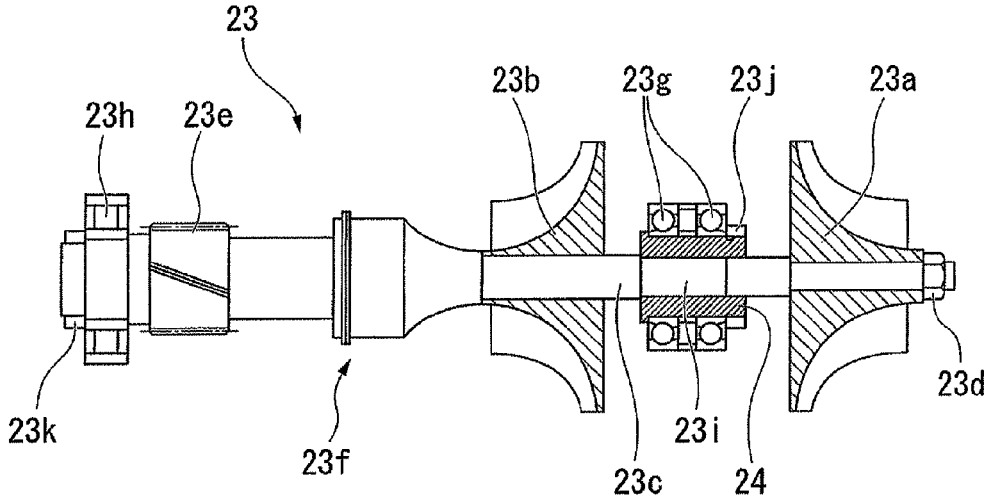
FIG. 2 is a plan view of a rotor assembly according to the embodiment of the invention.
Figure 3A:
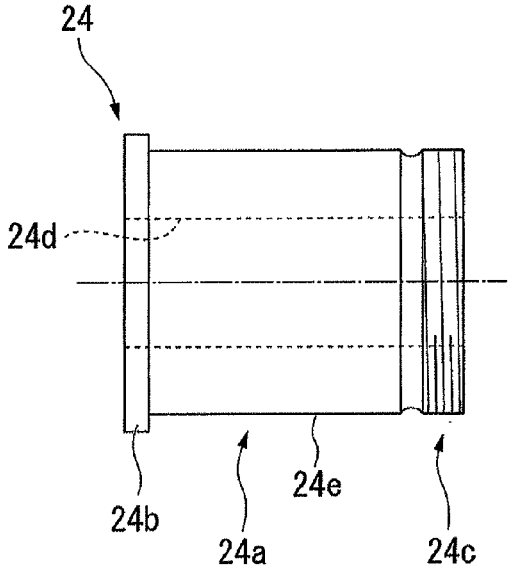
FIG. 3A is a schematic diagram of a sleeve according to the embodiment of the invention.
Figure 3B:
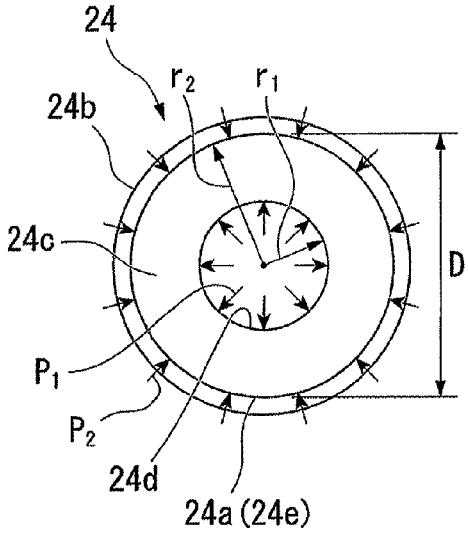
FIG. 3B is a schematic diagram of the sleeve according to the embodiment of the invention.
Figure 4:
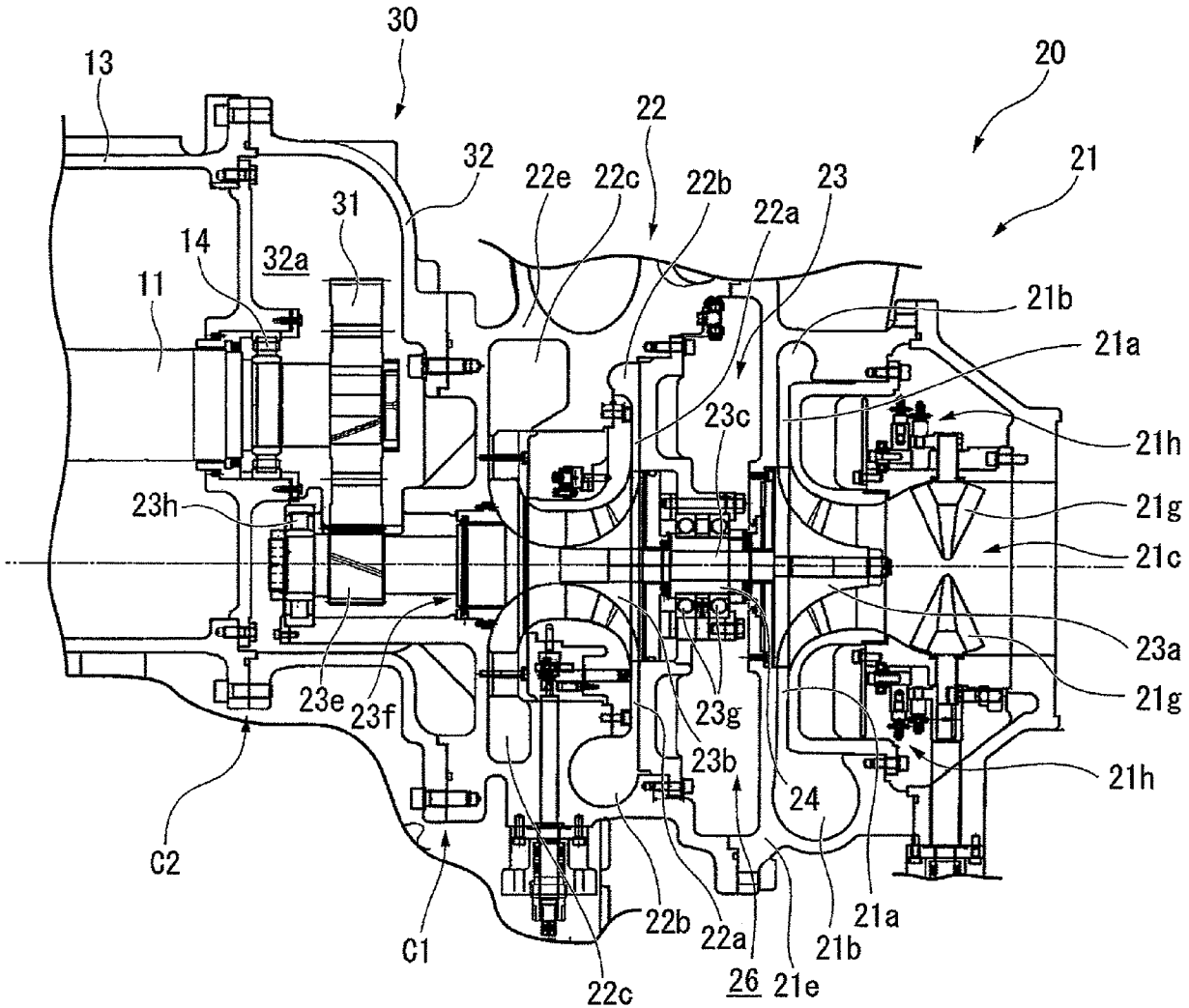
FIG. 4 is a horizontal enlarged cross-sectional view of a compressor unit and a gear unit according to the embodiment of the invention.

FIG. 1 is a horizontal cross-sectional view of a turbo compressor 1 according to this embodiment. In addition, FIG. 2 is a plan view of a rotor assembly 23 according to this embodiment. In addition, FIG. 3A is a plan view of a schematic diagram of a sleeve 24 according to this embodiment. FIG. 3B is a front view of the schematic diagram of the sleeve 24 according to this embodiment. In addition, FIG. 4 is a horizontal enlarged cross-sectional view of a compressor unit 20 and a gear unit 30 included in the turbo compressor 1 according to this embodiment.

The turbo compressor 1 according to this embodiment is used in a turbo refrigerator (not shown) provided in a building, a factory, or the like to generate air-conditioning cooling water, and compresses and discharges a refrigerant gas introduced from an evaporator (not shown) of the turbo refrigerator. As shown in FIG. 1, the turbo compressor 1 includes a motor unit 10, a compressor unit 20, and a gear unit 30.

The motor unit 10 has an output shaft 11 and includes a motor 12 which generates rotating power to drive the compressor unit 20 and a motor casing 13 which encloses the motor 12 and in which the motor 12 is provided. In addition, a driving unit that drives the compressor unit 20 is not limited to the motor 12, and for example, may also be an internal combustion engine.

The output shaft 11 of the motor 12 is supported so as to be rotatable by a first bearing 14 and a second bearing 15 which are fixed to the motor casing 13.

The compressor unit 20 includes a first compression stage 21 that intakes and compresses the refrigerant gas and a second compression stage 22 that further compresses the refrigerant gas compressed by the first compression stage 21 to be discharged as a compressed refrigerant gas. In addition, inside the compressor unit 20, a rotor assembly 23 that is provided in both the first and second compression stages 21 and 22 is provided.

The configuration of the rotor assembly 23 which is a feature of the turbo compressor 1 will be described. As shown in FIG. 2, in the rotor assembly 23, a first impeller 23*a* and a second impeller (impeller) 23*b* are fixed to a rotation shaft 23*c* extending in a predetermined direction (a direction in which the first and second compression stages 21 and 22 are opposed, see FIG. 1).

The first and second impellers 23*a* and 23*b* each have a configuration in which a plurality of blades are lined up in a peripheral direction on a peripheral surface of a substantially conical hub, and are fixed to the rotation shaft 23*c* so that their rear surface sides (bottom surface sides of the conical hubs) are in a posture opposed to each other. The first impeller 23*a* is fixed to one end side of the rotation shaft 23*c* using a nut 23*d*. The second impeller 23*b* is fixed to the substantially center portion of the rotation shaft 23*c* by shrink-fitting, press-fitting, or the like.

The rotation shaft 23*c* is, for example, a bar-shaped member molded of chrome molybdenum steel having high rigidity. A pinion gear 23*e* is molded on the opposite side of the rotation shaft 23*c* to a side to which the first impeller 23*a* is fixed. The pinion gear 23*e* is a gear for transmitting the rotating power of the motor 12 (see FIG. 1) to the first and second impellers 23*a* and 23*b* and is molded integrally with the rotation shaft 23*c* when the rotation shaft 23*c* is molded. Between the pinion gear 23*e* of the rotation shaft 23*c* and the second impeller 23*b*, a labyrinth seal 23*f* for preventing leakage of the refrigerant gas from the second compression stage 22 toward the gear unit 30 is provided. The labyrinth seal 23*f* surrounds the rotation shaft 23*c* and is fixed thereto by shrink-fitting, press-fitting, or the like. Moreover, similarly to the pinion gear 23*e*, the labyrinth seal 23*f* may also be molded integrally with the rotation shaft 23*c* when the rotation shaft 23*c* is molded.

In addition, the rotation shaft 23*c* is provided with a third bearing (bearing) 23*g* and a fourth bearing 23*h*. Both the third and fourth bearings 23*g* and 23*h* are rolling-element bearings and support the rotation shaft 23*c* so as to be rotatable.

The third bearing 23*g* is a bearing (a so-called angular bearing) capable of supporting loads in both the radial and thrust directions. The third bearing 23*g* is fixed to the rotation shaft 23*c* via a sleeve 24 between the first and second impellers 23*a* and 23*b*. The sleeve 24 is a member molded in a substantially cylindrical shape (see FIGS. 3A and 3B) and is fitted and fixed to a supporting portion 23*i* of the rotation shaft 23*c* between the first and second impellers 23*a* and 23*b* by shrink-fitting, press-fitting, or the like. Similarly, the third bearing 23*g* is fitted and fixed to the sleeve 24 by shrink-fitting, press-fitting, or the like. Since the sleeve 24 is provided between the rotation shaft 23*c* and the third bearing 23*g*, a large bearing can be used as the third bearing 23*g* without the use of a rotation shaft 23*c* having a large diameter. Moreover, in order to regulate movement of the third bearing 23*g* fitted to the sleeve 24 in an axial line direction of the rotation shaft 23*c*, the sleeve 24 is provided with a first snap ring 23*j* having an annular shape from the first impeller 23*a* side.

As shown in FIG. 3A, the sleeve 24 has a configuration in which a flange portion 24*b* is molded to widen from one end side of a cylindrical sleeve main body 24*a* in the diameter direction, and a male threaded portion 24*c* is formed on the other side. In addition, the sleeve 24 is molded using general carbon steel (ordinary steel). The flange portion 24*b* is a regulating portion for preventing the third bearing 23*g* fitted to the sleeve 24 from moving toward the second impeller 23*b*. The male threaded portion 24*c* is a portion to which the first snap ring 23*j* is mounted. To an inner peripheral surface 24*d* of the sleeve main body 24*a*, the supporting portion 23*i* of the rotation shaft 23*c* is fitted with a predetermined interference, and to the outer peripheral surface 24*e* of the sleeve main body 24*a*, the third bearing 23*g* is fitted with a predetermined interference (see FIG. 2).

As shown in FIG. 2, the fourth bearing 23*h* is fitted and fixed to the rotation shaft 23*c* on the opposite side to the labyrinth seal 23*f* with the pinion gear 23*e* interposed therebetween by shrink-fitting, press-fitting, or the like. Moreover, in order to regulate the movement of the fourth bearing 23*h* fitted to the rotation shaft 23*c* in the axial line direction of the rotation shaft 23*c*, a second snap ring 23*k* having an annular shape is provided in the rotation shaft 23*c*. The second snap ring 23*k* is mounted to a male threaded portion (not shown) formed on an end portion of the rotation shaft 23*c*.

Subsequently, the configurations of the first compression stage 21, the second compression stage 22, and the gear unit 30 are described.

As shown in FIG. 4, the first compression stage 21 includes a first diffuser 21*a* that compresses the refrigerant gas by converting the velocity energy of the refrigerant gas applied by the rotating first impeller 23*a* into pressure energy, a first scroll chamber 21*b* that leads the refrigerant gas compressed by the first diffuser 21*a* to the outside of the first compression stage 21, and an intake 21*c* that intakes the refrigerant gas to be supplied to the first impeller 23*a*.

Moreover, some portions of the first diffuser 21*a*, the first scroll chamber 21*b*, and the intake 21*c* are formed by a first impeller casing 21*e* that encloses the first impeller 23*a*.

In the intake 21*c* of the first compression stage 21, a plurality of inlet guide vanes 21*g* for controlling the intake capacity of the first compression stage 21 is installed.

Each of the inlet guide vanes 21*g* is rotated by a drive mechanism 21*h* fixed to the first impeller casing 21*e* so as to change the apparent area of the refrigerant gas from the upstream side of a flow direction. In addition, outside the first impeller casing 21*e*, a vane driving unit 25 (see FIG. 1) that rotates and drives each of the inlet guide vanes 21*g* connected to the drive mechanism 21*h* is installed.

The second compression stage 22 includes a second diffuser 22*a* that compresses the refrigerant gas by converting the velocity energy of the refrigerant gas applied by the rotating second impeller 23*b* into pressure energy so as to be discharged as the compressed refrigerant gas, a second scroll chamber 22*b* that leads the compressed refrigerant gas discharged from the second diffuser 22*a* to the outside of the second compression stage 22, and an introduction scroll chamber 22*c* that guides the refrigerant gas compressed by the first compression stage 21 to the second impeller 23*b*.

Moreover, the second diffuser 22*a*, the second scroll chamber 22*b*, and the introduction scroll chamber 22*c* are formed by a second impeller casing 22*e* that encloses the second impeller 23*b*.

The first scroll chamber 21*b* of the first compression stage 21 and the introduction scroll chamber 22*c* of the second compression stage 22 are connected via an external pipe (not shown) which is provided separately from the first and second compression stages 21 and 22 such that the refrigerant gas compressed by the first compression stage 21 is supplied to the second compression stage 22 via the external pipe.

The third bearing 23*g* of the rotor assembly 23 is fixed to the second impeller casing 22*e* in a space 26 between the first and second compression stages 21 and 22, and the fourth bearing 23*h* is fixed to the second impeller casing 22*e* on the gear unit 30 side. That is, the rotation shaft 23*c* of the rotor assembly 23 is supported inside the compressor unit 20 so as to be rotatable via the third and fourth bearings 23*g* and 23*h*.

The gear unit 30 includes a flat gear 31 which transmits the rotating power of the motor 12 to the rotation shaft 23*c* from the output shaft 11, and is fixed to the output shaft 11 of the motor 12 and is engaged with the pinion gear 23*e* of the rotation shaft 23*c*, and a gear casing 32 which accommodates the flat gear 31 and the pinion gear 23*e*.

The flat gear 31 has an outside diameter greater than that of the pinion gear 23*e*. As the flat gear 31 and the pinion gear 23*e* cooperate with each other, the rotating power of the motor 12 is transmitted to the rotation shaft 23*c* so that the number of rotation of the rotation shaft 23*c* becomes greater than that of the output shaft 11. Moreover, a transmission method is not limited to the above method, and the diameters of a plurality of gears may be set so that the number of the rotation shaft 23*c* is the same as or smaller than that of the output shaft 11. In order to ensure proper rotation of the flat gear 31 and the pinion gear 23*e* engaged with each other, the spacing therebetween is set to an appropriate value.

The gear casing 32 accommodates the flat gear 31 and the pinion gear 23*e* in an internal space 32*a* formed therein and are molded as a separate member from the motor casing 13 and the second impeller casing 22*e* so as to connect the motor casing 13 and the second impeller casing 22*e*. In addition, an oil tank 33 (see FIG. 1) that recovers and stores a lubricating oil supplied to sliding parts of the turbo compressor 1 is connected to the gear casing 32.

The gear casing 32 is connected to the second impeller casing 22*e* at a first connection portion C1, and is connected to the motor casing 13 at a second connection portion C2.

Next, a method of manufacturing the rotor assembly 23 according to this embodiment will be described. The description will be provided appropriately referring to FIGS. 2, 3A, 3B.

First, each of the first impeller 23*a*, the second impeller 23*b*, the rotation shaft 23*c*, the labyrinth seal 23*f*, and the sleeve 24 is manufactured by casting, machining work, or the like. Here, manufacturing of the sleeve 24 which is a feature of this embodiment will be described in detail.

As described above, the sleeve 24 is fitted and fixed to the supporting portion 23*i* of the rotation shaft 23*c* with a predetermined interference. Accordingly, when the sleeve 24 is fitted to the rotation shaft 23*c*, the sleeve main body 24*a* is biased outward from the rotation shaft 23*c* in the diameter direction, and the outer peripheral surface 24*e* thereof is swollen, so that the outside diameter D of the sleeve main body 24*a* expands. In addition, although the third bearing 23*g* is fitted and fixed to the outer peripheral surface 24*e* of the sleeve main body 24*a*, in order to prevent seizing or the like and ensure a long bearing life span of the third bearing 23*g*, the interference between the sleeve main body 24*a* and the third bearing 23*g* needs to be adjusted to a suitable value. That is, at the time of fitting the third bearing 23*g* to the sleeve main body 24*a*, the outside diameter D needs to be set to a suitable outside diameter measurement corresponding to the inside diameter of the third bearing 23*g*.

Here, in this embodiment, the sleeve 24 is manufactured according to the expansion of the outside diameter D of the sleeve main body 24*a*, which is going to be caused by fitting the sleeve 24 to the rotation shaft 23*c*. More specifically, so as to cause the outside diameter D to be the suitable outside diameter measurement corresponding to the inside diameter of the third bearing 23*g* by the expansion, during the manufacturing of the sleeve 24, the outside diameter D is set to a measurement obtained by subtracting the expansion amount of the outside diameter D from the suitable outside diameter measurement.

As a method of calculating the expansion amount of the outside diameter D when the sleeve 24 is fitted to the rotation shaft 23*c*, first, a first pressure $P_1$ exerted on the inner peripheral surface 24*d* of the sleeve main body 24*a* by the rotation shaft 23*c* when the sleeve 24 is fitted to the rotation shaft 23*c* with an interference δ in the radial direction is calculated, and the expansion amount of the outside diameter D of the sleeve main body 24*a* is calculated on the basis of the calculated first pressure $P_1$.

When the sleeve 24 is fitted to the rotation shaft 23*c* with the interference 8 in the radial direction, the first pressure $P_1$ exerted on the inner peripheral surface 24*d* by the rotation shaft 23*c* is generally given by the following expression (1).

Here, $E_1$ is modulus of longitudinal elasticity of the rotation shaft 23*c*, $\nu_1$ is Poisson's ratio of the rotation shaft 23*c*, $E_2$ is modulus of longitudinal elasticity of the sleeve 24, $\nu_2$ is Poisson's ratio of the sleeve 24, $r_1$ is radius of the sleeve main body 24*a* on the inner peripheral surface 24*d* side, and $r_2$ is radius of the sleeve main body 24*a* on the outer peripheral surface 24*e* side.

$$P_1=(\delta/r_1)\{1/[(r_2^2+r_1^2)/E_2(r_2^2-r_1^2)+\nu_2/E_2-(\nu_1-1)/E_1]\} \quad (1)$$

Next, on the basis of the calculated first pressure $P_1$ and a second pressure $P_2$ (in general, atmospheric pressure) exerted inward from the outer peripheral surface 24*e* of the sleeve main body 24*a*, a displacement u of the outer peripheral surface 24*e* of the sleeve main body 24*a* in the radial direction when the sleeve 24 is fitted to the rotation shaft 23*c* is calculated. The displacement u is generally given by the following expression (2).

$$u = \frac{\{2P_1 r_1^2 r_2^2 - P_2 r_2^2[(1-\nu_2)r_2^2 + (1+\nu_2)r_1^2]\}}{E_2(r_2^2 - r_1^2)r_2} \quad (2)$$

Since the displacement u is a displacement in the radial direction, the expansion amount of the outside diameter D of the sleeve main body 24*a* becomes 2u. Therefore, the sleeve 24 is manufactured to have an outside diameter measurement obtained by subtracting the expansion amount 2u from the suitable outside diameter measurement corresponding to the inside diameter of the third bearing 23*g*. Moreover, after purchasing a sleeve molded substantially in a cylindrical shape in advance, only the outer peripheral surface of the sleeve may be adjusted to the outside diameter according to the expansion.

Subsequently, the rotor assembly 23 is assembled using the components each manufactured. First, after the labyrinth seal 23*f* is fixed to the rotation shaft 23*c*, the second impeller 23*b* is fitted and fixed to the rotation shaft 23*c* by shrink-fitting, press-fitting, or the like. The second impeller 23*b* is inserted from the opposite side to the side where the pinion gear 23*e* of the rotation shaft 23*c* is provided, is passed through the supporting portion 23*i*, and is fixed to a predetermined position.

Next, the sleeve 24 is fitted and fixed to the supporting portion 23*i* of the rotation shaft 23*c* by shrink-fitting, press-fitting, or the like.

Here, as the sleeve 24 is fitted to the rotation shaft 23*c* with the interference δ in the radial direction, the outside diameter D of the sleeve main body 24*a* expands after fixing the sleeve 24. Above all, as described above, during the manufacturing of the sleeve 24, the sleeve 24 is manufactured in advance to have the outside diameter obtained by subtracting the expansion amount 2u during fitting from the suitable outside diameter measurement corresponding to the inside diameter of the third bearing 23*g*. Accordingly, the outside diameter D of the sleeve main body 24*a* after fixing the sleeve 24 has the suitable outside diameter measurement corresponding to the inside diameter of the third bearing 23*g*. That is, after the sleeve 24 is fitted and fixed to the rotation shaft 23*c*, there is no need to adjust the outside diameter D of the sleeve main body 24*a* to the suitable outside diameter measurement by machining the outer peripheral surface 24*e* of the sleeve main body 24*a*. Therefore, there is no need to perform machining work again during assembly of the rotor assembly 23, and laboriousness and costs in manufacturing the rotor assembly 23 can be reduced.

Thereafter, the third bearing 23*g* is fitted and fixed to the sleeve 24 by shrink-fitting, press-fitting, or the like. Since the sleeve main body 24*a* has the suitable outside diameter measurement corresponding to the inside diameter of the third bearing 23*g*, the third bearing 23*g* can be used under a suitable use condition. As a result, the third bearing 23*g* can be used for a long time. In addition, since the rotor assembly 23 according to this embodiment has the configuration in which the sleeve 24 is interposed between the rotation shaft 23*c* and the third bearing 23*g*, a large bearing can be used as the third bearing 23*g* without the use of a rotation shaft 23*c* having a large diameter. Therefore, a long bearing life span can be ensured for the rotor assembly 23.

Moreover, the third bearing 23*g* is fixed to the sleeve 24, and the fourth bearing 23*h* is fitted and fixed to the rotation shaft 23*c*. Lastly, the first impeller 23*a* is fixed to the rotation shaft 23*c* using the nut 23*d* after the rotation shaft 23*c* is provided inside the compressor unit 20.

Here, the second impeller 23*b* may be fixed to the rotation shaft 23*c* before fitting the sleeve 24 to the rotation shaft 23*c*.

As such, the manufacturing operation of the rotor assembly 23 is ended.

Subsequently, operations of the turbo compressor 1 according to this embodiment will be described.

First, the rotating power of the motor 12 is transmitted to the rotation shaft 23*c* via the flat gear 31 and the pinion gear 23*e*, and thus the first and second impellers 23*a* and 23*b* of the compressor unit 20 are driven to rotate.

When the first impeller 23*a* is driven to rotate, the intake 21*c* of the first compression stage 21 is in a negative pressure state, so that the refrigerant gas flows into the first compression stage 21 via the intake 21*c*. The refrigerant gas flowing into the first compression stage 21 flows to the first impeller 23*a* in the thrust direction and is given velocity energy by the first impeller 23*a* so as to be discharged in the radial direction.

The refrigerant gas discharged from the first impeller 23*a* is compressed as its velocity energy is converted into pressure energy by the first diffuser 21*a*.

The refrigerant gas discharged from the first diffuser 21*a* is led to the outside of the first compression stage 21 via the first scroll chamber 21*b*.

In addition, the refrigerant gas led to the outside of the first compression stage 21 is supplied to the second compression stage 22 via the external pipe (not shown).

The refrigerant gas supplied to the second compression stage 22 flows into the second impeller 23*b* in the thrust direction via the introduction scroll chamber 22*c* and is discharged in the radial direction in which velocity energy is applied thereto by the second impeller 23*b*.

The refrigerant gas discharged from the second impeller 23*b* is further compressed as its velocity energy is converted into pressure energy by the second diffuser 22*b* to become the compressed refrigerant gas.

The compressed refrigerant gas discharged from the second diffuser 22*b* is led to the outside of the second compression stage 22 via the second scroll chamber 22*b*.

As such, the operations of the turbo compressor 1 are ended.

Therefore, according to this embodiment, the following advantages can be obtained.

According to this embodiment, since the sleeve 24 is provided between the rotation shaft 23*c* and the third bearing 23*g*, a large bearing can be used as the third bearing 23*g*. Therefore, there is an advantage that a long bearing life span can be ensured for the rotor assembly 2.

While the exemplary embodiments related to the invention have been described with reference to the accompanying drawings, it is needless to say that the invention is not limited to the embodiments. The shapes and combinations of the constituent members described in the above embodiments are only examples and can be modified in various manners depending on design requirements without departing from the scope of the invention.

For example, in this embodiment, the turbo compressor 1 is used in the turbo refrigerator (not shown). However, the invention is not limited thereto, and the turbo compressor 1 may also be used as a supercharger that supplies compressed air to an internal combustion engine.

What is claimed is:

1. A method of manufacturing a rotor assembly in which a first impeller and a second impeller are fixed to a rotation shaft which is supported by a bearing so as to be rotatable, the method comprising:

fixing the second impeller to the rotation shaft;

fitting and fixing a sleeve to the rotation shaft after fixing the second impeller, the sleeve having a cylindrical main body, a radially extending flange portion at one end of the cylindrical main body, and a male threaded portion at another end of the cylindrical main body;

fitting and fixing the bearing to the sleeve after fitting and fixing the sleeve;

mounting an annular first snap ring from the first impeller side of the rotation shaft on the male threaded portion; and fixing the first impeller after fitting and fixing the bearing.

2. The method according to claim 1, further comprising, before fitting and fixing the sleeve, adjusting the sleeve to an outside diameter measurement corresponding to a change in an outside diameter of the sleeve which is going to be caused while fitting and fixing the sleeve.

3. The method according to claim 2, wherein, in adjusting the sleeve, the sleeve is adjusted to the outside diameter measurement obtained by subtracting an expansion amount of the outside diameter of the sleeve which is going to be caused while fitting and fixing the sleeve, from a predetermined outside diameter measurement.

4. A rotor assembly comprising:

a rotation shaft supported by a bearing so as to be rotatable;

an impeller fixed to the rotation shaft; and a sleeve which is fitted and fixed to the rotation shaft and is provided inside the bearing, wherein a flange portion, which widens from one end side of a cylindrical main body of the sleeve in the diameter direction, is provided in the sleeve, a male threaded portion is formed in the other end side of the cylindrical main body of the sleeve, and an annular first snap ring is provided in the male threaded portion.

5. A turbo compressor which compresses a gas introduced from the outside so as to be discharged by rotating a rotor assembly including an impeller, wherein, as the rotor assembly, the rotor assembly according to the claim 4 is included.

* * * * *